US008334469B2

(12) United States Patent
Takenaka

(10) Patent No.: US 8,334,469 B2
(45) Date of Patent: Dec. 18, 2012

(54) INTERLOCK SWITCH AND IMAGE FORMING APPARATUS USING THE SAME

(75) Inventor: Kohta Takenaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 290 days.

(21) Appl. No.: 12/805,687

(22) Filed: Aug. 13, 2010

(65) Prior Publication Data

US 2011/0056811 A1 Mar. 10, 2011

(30) Foreign Application Priority Data

Sep. 9, 2009 (JP) ..... 2009-208085

(51) Int. Cl.
*H01H 9/22* (2006.01)

(52) U.S. Cl. ..... 200/50.02; 200/61.62; 200/333

(58) Field of Classification Search .... 200/50.01–50.02, 200/50.1, 50.12, 61.62, 61.7, 61.71, 61.73, 200/333
See application file for complete search history.

(56) References Cited

U.S. PATENT DOCUMENTS

| | | | | |
|---|---|---|---|---|
| 4,978,817 | A * | 12/1990 | Honda | 200/50.1 |
| 6,542,712 | B2 | 4/2003 | Kamijo et al. | |
| 6,658,222 | B2 | 12/2003 | Kamijo et al. | |
| 6,731,900 | B2 | 5/2004 | Takenaka et al. | |
| 6,731,902 | B2 | 5/2004 | Takenaka et al. | |
| 6,788,916 | B2 | 9/2004 | Takenaka et al. | |
| 6,801,744 | B2 | 10/2004 | Fujiwara et al. | |
| 6,907,218 | B2 | 6/2005 | Fujiwara et al. | |
| 7,013,108 | B2 | 3/2006 | Takenaka et al. | |
| 7,141,750 | B2 * | 11/2006 | Yamada | 200/341 |
| 7,329,820 | B2 * | 2/2008 | Yamamoto | 200/61.62 |
| 7,454,157 | B2 | 11/2008 | Yamada et al. | |
| 7,511,238 | B2 * | 3/2009 | Sugane et al. | 200/61.62 |
| 8,084,702 | B2 * | 12/2011 | Kawarago | 200/50.1 |
| 2007/0196152 | A1 | 8/2007 | Shimizu et al. | |
| 2008/0304866 | A1 | 12/2008 | Takenaka et al. | |
| 2010/0232822 | A1 | 9/2010 | Takenaka et al. | |

FOREIGN PATENT DOCUMENTS

| | | |
|---|---|---|
| JP | 03-754777 | 12/2005 |
| JP | 2006-164918 | 6/2006 |

* cited by examiner

*Primary Examiner* — Xuong Chung Trans
(74) *Attorney, Agent, or Firm* — Harness, Dickey & Pierce, P.L.C.

(57) ABSTRACT

An interlock switch includes a switch mechanism. The switch mechanism includes a switch having an arm as an actuator, a holding member to which the switch is fastened by a rocking mechanism, the holding member being rotatably disposed in an apparatus body, one pressing member which presses the arm from the arm side, other pressing member which presses the holding member from the side opposite to the arm side, one elastic member which regulates the ON position of the switch in a releasing direction in arm-side view, and other elastic member which applies a force to the switch in a direction in which the one pressing member comes close to the switch. The switch is turned on when the one pressing member presses the arm from the arm side and the other pressing member presses the holding member from the side opposite to the arm side.

6 Claims, 7 Drawing Sheets

INTERLOCK SWITCH AND IMAGE FORMING APPARATUS USING THE SAME

CROSS-REFERENCE TO RELATED APPLICATIONS

The present application claims priority to and incorporates by reference the entire contents of Japanese Patent Application No. 2009-208085 filed in Japan on Sep. 9, 2009.

BACKGROUND OF THE INVENTION

1. Field of the Invention

The present invention relates to an interlock switch that is used in various image forming apparatuses, such as a copy machine, a facsimile, a printer, and a multifunctional apparatus thereof, and an image forming apparatus using the same.

2. Description of the Related Art

A conventional interlock switch mechanism that is used in an image forming apparatus will be described. In the image forming apparatus, covers are provided on a paper discharge port and a back surface to remove jammed paper. In general, one switch is used for one cover. However, two covers may be detected by one switch to save a space and reduce a cost.

The case where two facing covers are detected by one switch will be described.

FIG. 1 is a lateral view illustrating a printer body 1. In the printer body 1, a pressing member 3 is provided in a back cover 2 and a pressing member 6 is disposed in a paper discharge cover 4, and one switch (not shown in the drawings) is turned on, in a state where the two covers 2 and 4 are closed.

FIG. 2 shows a conventional switch mechanism. A switch 10 is mounted in a holding member 11, and the holding member 11 has a rotation shaft 20 and is mounted in a body of an image forming apparatus such as a printer shown in FIG. 1. In the holding member 11 of the switch 10, the rotation force is applied to the switch 10 by a spring 13 (elastic member) in a direction away from a pressing member 14. If the pressing member 14 and another pressing member 15 that is provided on the opposite side (upper side in an example of the drawing) of the holding member 11 are inserted, the switch 10 is first turned on.

In this interlock switch, if the distance of a front end of the pressing member 14 and the switch 10 changes due to dimensional errors or attachment errors of components, an arm 10*a* of the switch 10 may be inserted into a body (case or body) of the switch 10 beyond necessity and may plastically deform. As a result, erroneous detection may be generated and the switch 10 may be broken.

That is, in an interlock switch that is turned on/off by pressing members disposed in two facing door covers of an apparatus body supporting the interlock switch, the door covers being supported by the apparatus body so as to be opened and closed, in a switch mechanism in which a switch having an arm as an actuator is fastened to a switch holding member, the switch holding member is rotatably disposed in the apparatus body, and an ON position of the switch is regulated by an elastic member in a releasing direction in arm-side view, and which is pressed by one pressing member from the arm side and pressed by another pressing member from the side opposite to the arm side and can be turned on, if the pressing amount of a pressing means changes due to dimensional errors of the pressing member or attachment errors of doors, an operation failure or breakage of the switch may be caused.

For example, Japanese Patent Application Laid-open No. H10-162684 discloses an apparatus that has door covers opened and closed in plural direction and needs to operate an interlock apparatus with respect to each of the door covers, and can satisfy functions by the interlock apparatus of one system, even when the door covers are simultaneously opened, regardless of an opening/closing sequence of the door covers. This apparatus suggests an interlock mechanism of sides that go straight to each other.

Japanese Patent Application Laid-open No. 2006-164918 discloses an apparatus that can turn a switch ON and OFF and prevent the switch from being broken, even when the pressing amount of a pressing means changes due to a dimensional error of the pressing means or an attachment error of a door. A switch unit that includes an elastic member to apply a force to the switch in a pressing direction is suggested. In this switch unit, the switch and the pressing member are in a one-to-one relation.

SUMMARY OF THE INVENTION

It is an object of the present invention to at least partially solve the problems in the conventional technology.

According to one aspect of the present invention, an interlock switch includes a switch mechanism, and the switch mechanism includes: a switch having an arm as an actuator, a holding member to which the switch is fastened by a rocking mechanism, the holding member being rotatably disposed in an apparatus body, one pressing member which presses the arm from the arm side, other pressing member which presses the holding member from the side opposite to the arm side, one elastic member which regulates the ON position of the switch in a releasing direction in arm-side view, and other elastic member which applies a force to the switch in a direction in which the one pressing member comes close to the switch, wherein the switch is turned on when the one pressing member presses the arm from the arm side and the other pressing member presses the holding member from the side opposite to the arm side.

According to another aspect of the present invention, an image forming apparatus includes the interlock switch as described above as an opening/closing mechanism of door covers.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

As described above, the apparatus that is disclosed in Japanese Patent Application Laid-open No. H10-162684 suggests the interlock mechanism of the sides that go straight to each other. However, as an embodiment, the present invention suggests a mechanism that is used for opening/closing of sides facing each other.

In the switch unit that is disclosed in Japanese Patent Publication Laid-open No. 2006-164918, the switch and the pressing member are in a one-to-one relation. However, as embodiment, the present invention suggests a mechanism in which one switch is used with respect to two sides (two pressing members) facing each other.

Figure 1:
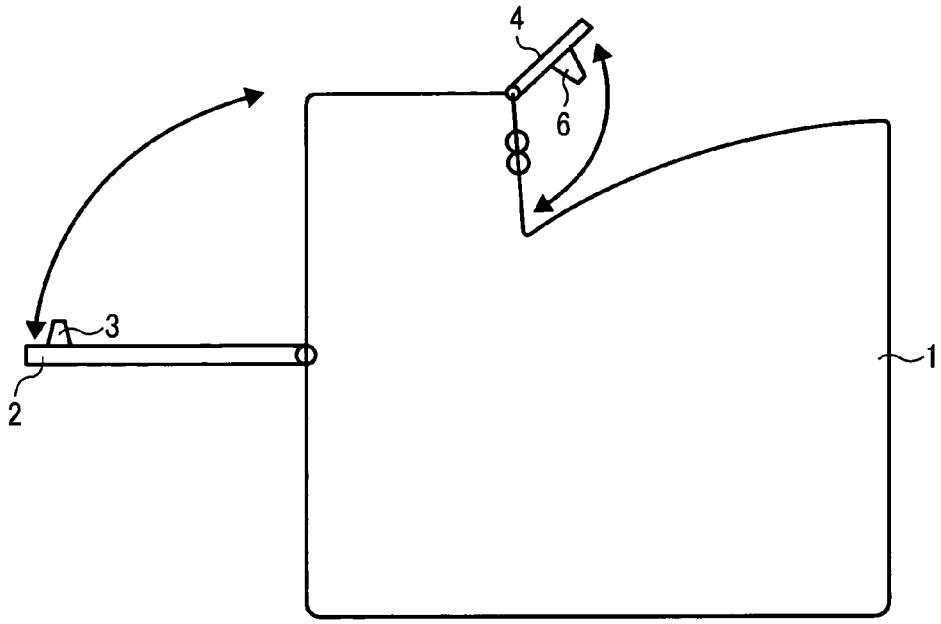
FIG. 1 is a lateral view illustrating a printer body.
Figure 2:
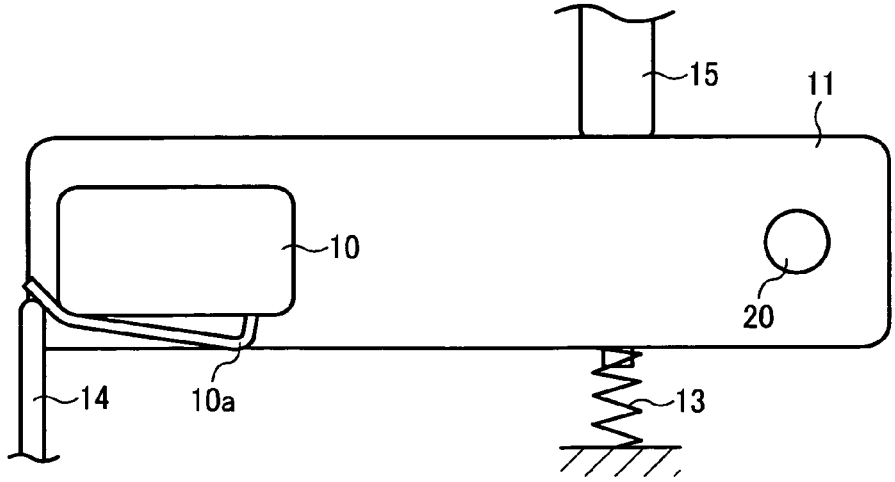
FIG. 2 is a diagram illustrating a conventional switch mechanism.

Hereinafter, embodiments of the present invention will be described with reference to the drawings. The present invention is not limited to an image forming apparatus shown in the drawings and can be applied to various apparatuses that form an image. Further, components that are common to those of the conventional apparatus depicted in FIGS. 1 and 2 are denoted by common reference numerals.

Figure 3:
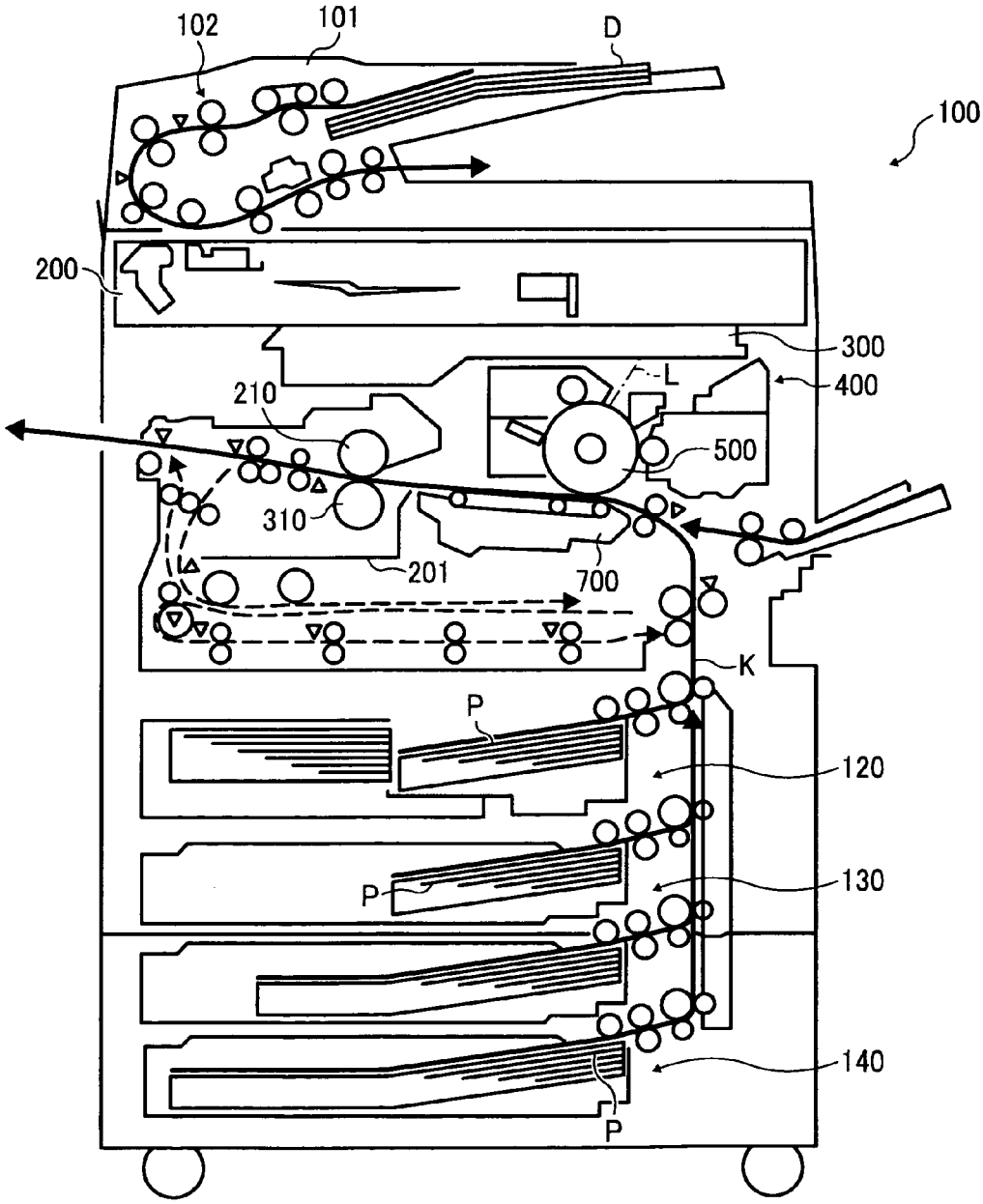
FIG. 3 is a diagram for explaining the overall configuration and operation of an image forming apparatus that is an implementation of the present invention.

FIG. 3 is a diagram for explaining the overall configuration and operation of an image forming apparatus which can be an implementation of the present invention. Depicted in FIG. 3 are: an apparatus body 100 of a copy machine which functions as the image forming apparatus; a document reading unit 200 which optically reads image information of a document D; an exposing unit 300 which irradiates exposure light L based on the image information read by the document reading unit 200 onto a photosensitive drum 500; an image forming unit 400 which forms a toner image (image) on the photosensitive drum 500; a transferring unit 700 which transfers the toner image formed on the photosensitive drum 500 to a recording medium P; a document conveying unit 101 which conveys the set documents D to the document reading unit 200; feeder units 120, 130, and 140 that store the recording media P, such as transfer paper; a fixing device 201 which fixes a yet-to-be-fixed image on the recording medium P; a fixing film 210 (or fixing roller: hereinafter referred to as fixing film) which functions as a fixing member disposed on the fixing device 201; and a pressurizing roller 310 which functions as a pressurizing member disposed on the fixing device 201.

An operation of the image forming apparatus at the time of normal image forming will be first described with reference to FIG. 3.

First, the document D is conveyed in an arrow direction of the drawing from a platen by a conveying roller 102 of the document conveying unit 101 and passes through the upper side of the document reading unit 200. At this time, in the document reading unit 200, image information of the document D that passes through the upper side is optically read. The optical image information that is read by the document reading unit 200 is converted into an electric signal and is transmitted to the exposing unit 300 (writing unit). The exposure light L, such as a laser beam, which is based on the image information of the electric signal, is emitted from the exposing unit 300 to the upper side of the photosensitive drum 500 of the image forming unit 400.

Meanwhile, in the image forming unit 400, the photosensitive drum 500 rotates in a clockwise direction in the drawing, and an image (toner image) corresponding to the image information is formed on the photosensitive drum 500 through predetermined image forming processes (charging process, exposing process, and developing process).

Then, the image that is formed on the photosensitive drum 500 is transferred to the recording medium P conveyed by a resist roller, by the transferring unit 700.

Meanwhile, the recording media P that are conveyed to the transferring unit 700 are operated as follows.

First, one feeder unit is automatically or manually selected among the plural feeder units 120 to 140 of the apparatus body 100 (for example, it is assumed that the feeder unit 120 positioned at an uppermost stage is selected). Among the recording media P stored in the feeder unit 120, one sheet of paper that is disposed at the uppermost side is conveyed to the position of a conveyance path K.

Then, the recording medium P passes through the conveyance path K and reaches the position of the resist roller. The recording medium P that reaches the position of the resist roller is conveyed to the transferring unit 700 after timing is adjusted for aligning the recording medium P with the image formed on the photosensitive drum 500.

After the transferring process, the recording medium P passes through the position of the transferring unit 700 and reaches the fixing device 201 via the conveyance path. After reaching the fixing device 201, the recording medium P is fed between the fixing film 210 and the pressurizing roller 310, and an image is fixed on the recording medium P by the heat received from the fixing film 210 and the pressure received from the fixing film 210 and the pressurizing roller 310. The recording medium P on which the image is fixed is transmitted from a portion (nip portion) between the fixing film 210 and the pressurizing roller 310 and is discharged from the apparatus body 100. In this way, a series of image forming processes are finished.

Next, a switch mechanism of an interlock switch according to a first embodiment of the present invention will be described. In the first embodiment of the present invention that is shown in FIGS. 4A to 8, a holding member 11 of a switch 10 includes a holding member 11*a* and a holding member 11*b*, the switch 10 is fastened to the holding member 11, and the holding member 11*a* and the holding member 11*b* are rotatably connected to a shaft 12. The holding member 11*b* is connected to the apparatus body of the image forming apparatus through a shaft 20. A pressing member 14 presses an arm 10*a* of the switch 10 and a pressing member 15 presses the holding member 11*b* from the side opposite to the side of the arm 10*a*. The force is applied to the switch 10 by a spring 13 corresponding to an elastic member, in a direction in which the pressing member 14 comes close to the switch 10. A spring 16 that corresponds to a second elastic member is stretched between the holding member 11*a* and the holding member 11*b* and applies a force to (i.e., pulls) the holding member 11*a* and the holding member 11*b* to bring them close to each other. Although not shown in the drawings, a rotation stopping member is preferably provided in the holding member 11*b* to regulate a rotation angle.

Figure 4A:
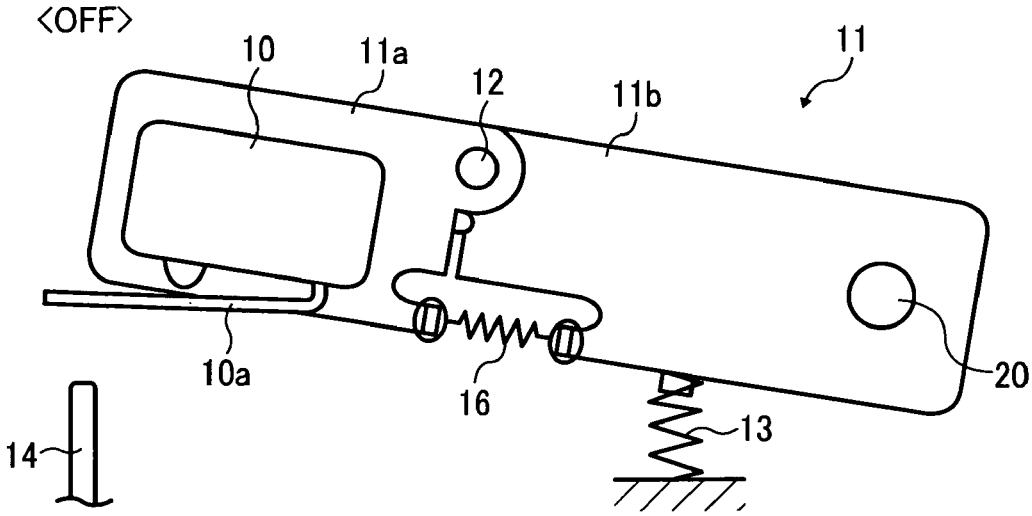
FIGS. 4A and 4B are diagrams illustrating a switch mechanism of an interlock switch according to a first embodiment of the present invention.
Figure 4B:
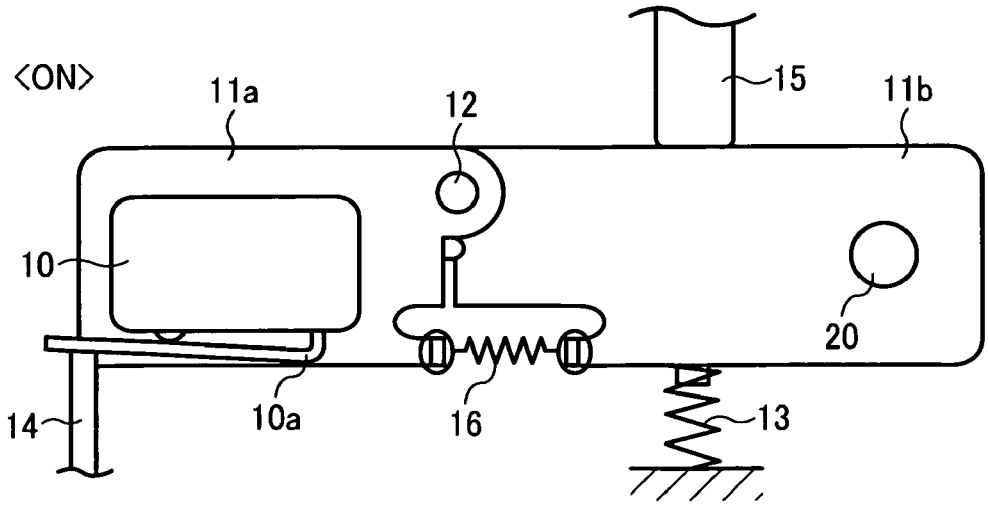
Figure 5:
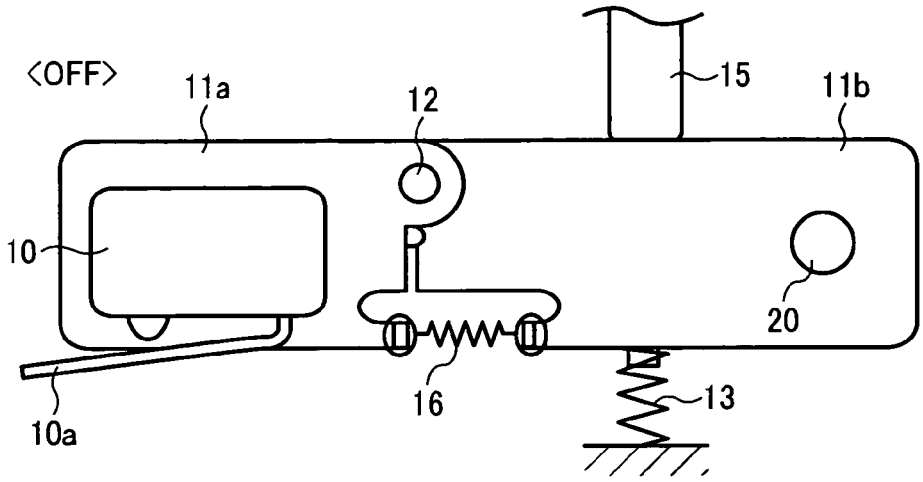
FIG. 5 is a diagram illustrating an off state in an example of FIGS. 4A and 4B.
Figure 6:
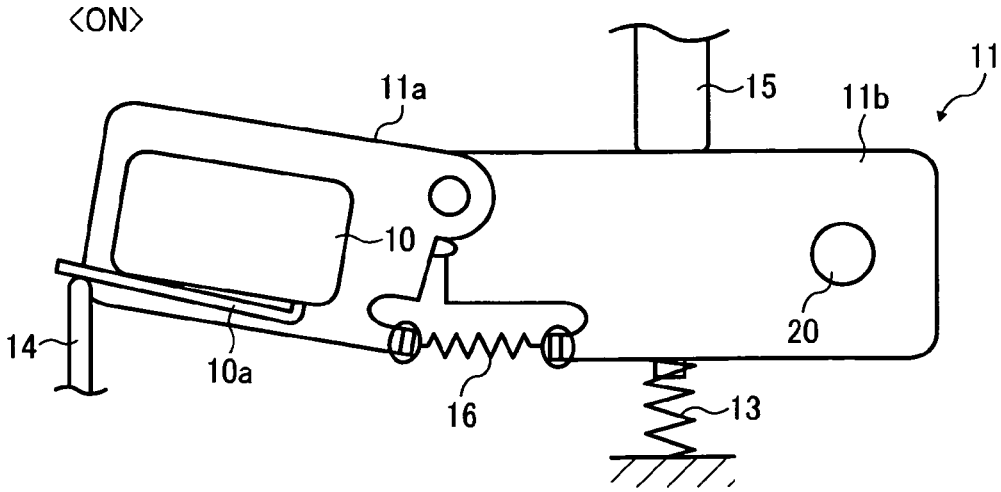
FIG. 6 is a diagram illustrating an on state in the example of FIGS. 4A and 4B.

A state shown in FIG. 4A corresponds to the case where only the pressing member 14 is inserted; and a state shown in FIG. 5 corresponds to the case where only the pressing member 15 is inserted. The switch 10 is turned off in both the states of FIGS. 4A and 5. When both the pressing members 14 and 15 are inserted, this state becomes a state shown in FIG. 4B and the switch 10 is turned on. When a rib becomes higher due to dimensional variations of the components, as shown in FIG. 6, the switch 10 rotates against the pulling force of the spring 16 and an arm 10*a* is prevented from being deformed.

Figure 7:
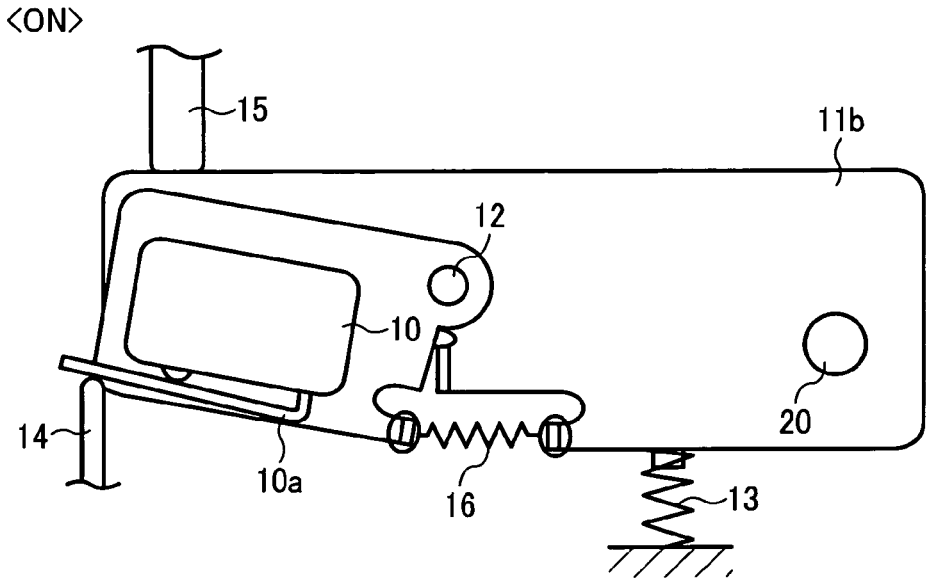
FIG. 7 is a diagram illustrating a modification of the example of FIGS. 4A and 4B.

FIG. 7 shows a modification having the configuration where the holding member 11*b* covers the holding member 11*a* by increasing the width of the holding member 11*b* as compared with FIGS. 4A and 4B. If the width of the holding member 11*b* is increased, the distance of the pressing members 14 and 15 can be reduced and the pressing members 14 and 15 can be disposed substantially in series.

Figure 8:
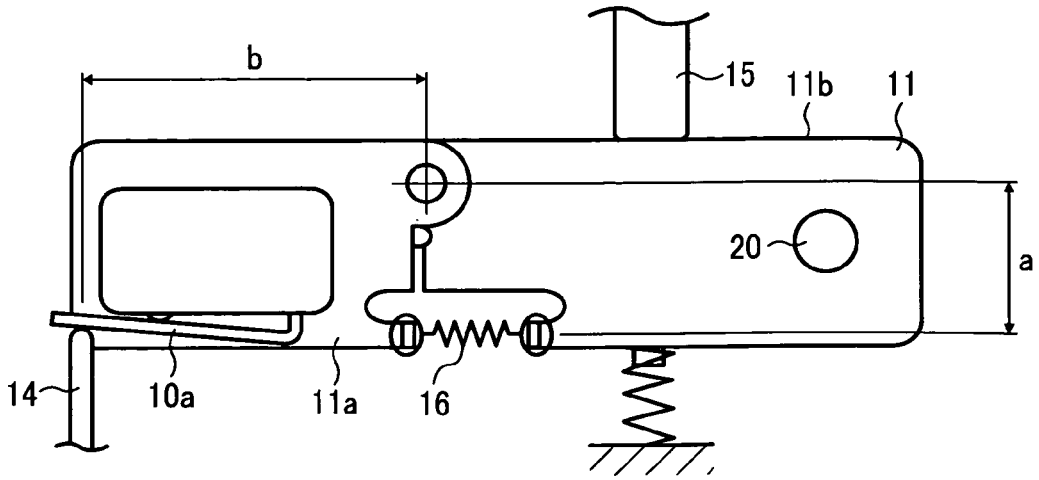
FIG. 8 is a diagram illustrating a relation example of dimensions in the case of a rotation mechanism according to the first embodiment shown in FIGS. 4A and 4B.

FIG. 8 is a diagram illustrating a relation example of dimensions in the case of the rotation mechanism according to this embodiment. In the switch mechanism according to the first embodiment described above, a relation between the initial tension A of the spring 16 and the operation force B of the switch 10 is preferably set as follows. That is, if the arm length of the moment that causes the pressing member 14 to rotate the switch 10 is set to a and the arm length of the moment that causes the spring 16 to reversely rotate the switch 10 is set to b, a value Aa that is obtained by multiplying the initial tension A of the second spring 16 by the arm length a of the moment that causes the pressing member 14 to rotate the switch 10 is preferably larger than a value that is obtained by multiplying the operation force B of the switch 10 by the arm length b of the moment to cause the spring 16 to reversely rotate the switch 10 ($A \times a > B \times b$). In this way, an erroneous detection operation can be prevented from being caused by a shifting operation of the switch 10 after the switch 10 is securely turned on, and an interlock switch mechanism that has safety and reliability can be provided.

Figure 9A:
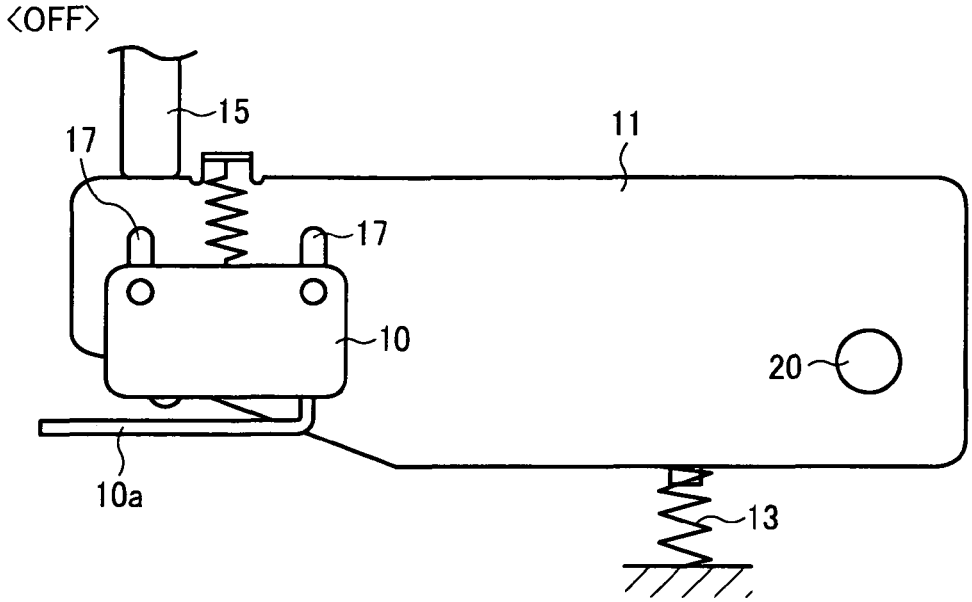
FIGS. 9A and 9B are diagrams illustrating a second embodiment of the present invention.
Figure 9B:
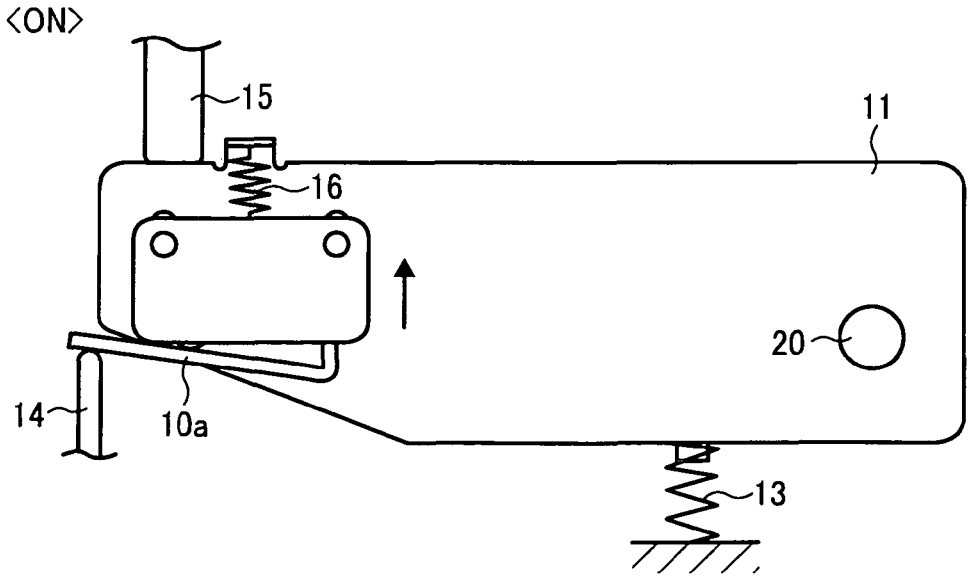

FIGS. 9A and 9B show the second embodiment of the present invention. In this embodiment, the holding member 11 is composed of one holding member, slide grooves 17 are provided in a portion of the holding member 11 where the switch 10 is mounted, and the switch 10 is mounted to the holding member 11 so as to be slid while being held by the holding member 11. In addition, the spring 16 is provided approximately right above the switch 10 to apply a force in such a direction that the sliding of the switch 10 is suppressed, and the position where the pressing member 15 comes into contact with the holding member 11 is slightly closer to a front end of the holding member 11 than the position where the spring 16 is provided. In the case of this slide mechanism, a relation between the initial tension A of the spring 16 and the operation force B of the switch 10 is set to $A>B$ to prevent the switch 10 from being easily slid.

A state shown in FIG. 9A corresponds to the case where only the pressing member 15 is inserted and the switch 10 is turned off in this state. When both the pressing members 14 and 15 are inserted, this state becomes a state shown in FIG. 9B and the switch 10 is turned on. If the switch 10 is pressed by the pressing member 14 beyond necessity, the switch 10 is slid in a direction away from the pressing member 14 along the slide groove 17 and escapes.

Figure 10A:
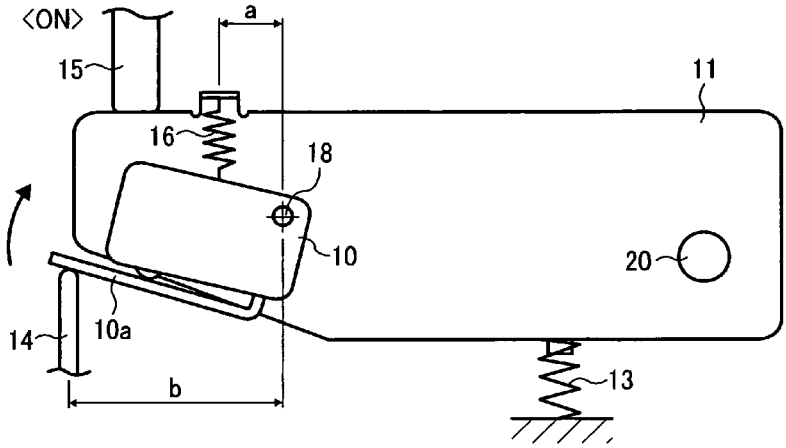
FIGS. 10A and 10B are diagrams illustrating a modification of the second embodiment of FIGS. 9A and 9B that has the configuration using a rotation mechanism to make a switch escape.
Figure 10B:
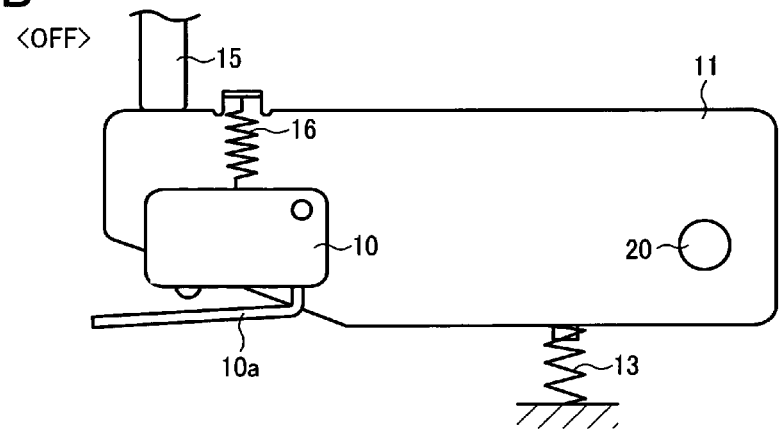

FIGS. 10A and 10B show a modification that has the configuration using a rotation mechanism to make the switch 10 escape. The switch 10 is rotatably mounted in the holding member 11 using a stepped screw 18. The operation is approximately the same as that of the example of FIGS. 9A and 9B. However, if the switch 10 is pressed by the pressing member 14 beyond necessity (refer to FIG. 10A), the switch 10 rotates around the stepped screw 18, rotates in a direction away from the pressing member 14, and thus escapes (refer to FIG. 10B).

Figure 11:
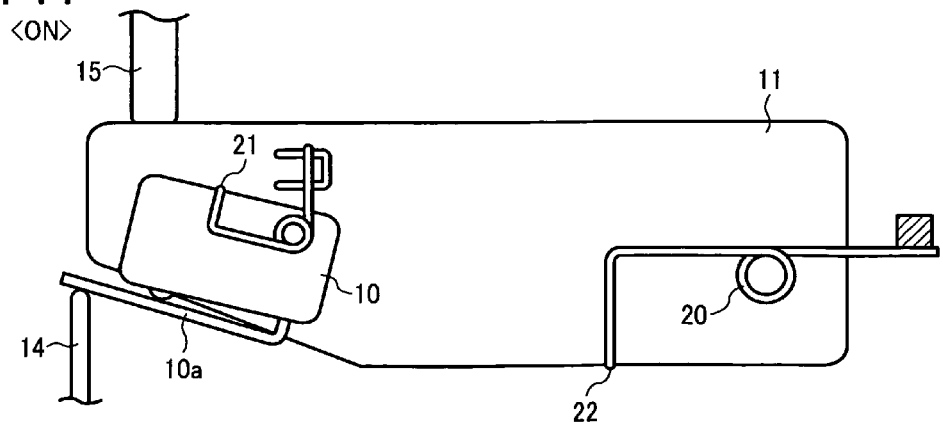
FIG. 11 is a diagram illustrating a modification of the second embodiment of FIGS. 9A and 9B in which a torsion spring is used in an elastic member, instead of a spring.

FIG. 11 shows a modification in which torsion springs 21 and 22 are used in the elastic member, instead of the spring. Since the other configuration and function are the same as those of the examples of FIGS. 9A, 9B, 10A and 10B, the description will not be repeated.

According to an aspect of the present invention, an interlock switch that can maintain safety and reliability without causing an operation failure or breakage of a switch, even when the pressing amount of a pressing means changes due to a dimensional error of the pressing means or an attachment error of a door, and an image forming apparatus using the same can be provided.

Further, an interlock switch that can prevent an erroneous detection operation from being generated due to a shifting operation of a switch after the switch is securely turned on and maintain safety and reliability, and an image forming apparatus using the same can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An interlock switch, comprising:

a switch mechanism including a switch having an arm as an actuator, a holding member to which the switch is fastened by a rocking mechanism, the holding member being rotatably disposed in an apparatus body, one pressing member which presses the arm from the arm side, other pressing member which presses the holding member from the side opposite to the arm side, one elastic member which regulates the ON position of the switch in a releasing direction in arm-side view, and other elastic member which applies a force to the switch in a direction in which the one pressing member comes close to the switch, wherein the switch is turned on when the one pressing member presses the arm from the arm side and the other pressing member presses the holding member from the side opposite to the arm side.

2. The interlock switch according to claim 1, wherein the holding member includes one holding member and other holding member, the one holding member is rotatably provided with respect to the other holding member, the one pressing member presses the arm of the switch, the other pressing member presses the other holding member from the side opposite to the arm side, and a relation between the initial tension A of the other elastic member and the operation force B of the switch is set to $Aa>Bb$, where "a" indicates the arm length of a moment to cause the pressing member to rotate the switch, and "b" indicates the arm length of a moment to cause the elastic member to reversely rotate the switch.

3. The interlock switch according to claim 1, wherein the switch is slidably provided with respect to the holding member, the one pressing member presses the arm of the switch, the other pressing member presses the other holding member from the side opposite to the arm side, and a relation between the initial tension A of the other elastic member and the operation force B of the switch is set to $A>B$.

4. An image forming apparatus comprising:

the interlock switch according to claim 1 as an opening/closing mechanism of door covers.

5. The image forming apparatus according to claim 4, wherein the interlock switch is provided in a body of the image forming apparatus, and the one pressing member and the other pressing member are provided in the two facing door covers supported to be opened and closed, respectively, to enable the interlock switch to be turned on/off.

6. The image forming apparatus according to claim 4, wherein the image forming apparatus is any one of a copy machine, a facsimile, a printer, and a multifunctional apparatus thereof.

* * * * *